US009297382B2

(12) United States Patent
Stones

(10) Patent No.: US 9,297,382 B2
(45) Date of Patent: Mar. 29, 2016

(54) SCROLL COMPRESSOR

(75) Inventor: Ian David Stones, Burgess Hill (GB)

(73) Assignee: Edwards Limited, Crawley (GB)

( * ) Notice: Subject to any disclaimer, the term of this patent is extended or adjusted under 35 U.S.C. 154(b) by 257 days.

(21) Appl. No.: 13/583,449

(22) PCT Filed: Feb. 17, 2011

(86) PCT No.: PCT/GB2011/050318
§ 371 (c)(1),
(2), (4) Date: Sep. 7, 2012

(87) PCT Pub. No.: WO2011/121320
PCT Pub. Date: Oct. 6, 2011

(65) Prior Publication Data

US 2013/0011288 A1 Jan. 10, 2013

(30) Foreign Application Priority Data

Mar. 30, 2010 (GB) ..... 1005273.6

(51) Int. Cl.

| | |
|---|---|
| ***F01C 1/02*** | (2006.01) |
| ***F01C 1/063*** | (2006.01) |
| ***F04C 2/00*** | (2006.01) |
| ***F04C 18/00*** | (2006.01) |
| ***F04C 18/02*** | (2006.01) |
| ***F04C 29/00*** | (2006.01) |
| *F04C 23/00* | (2006.01) |

(52) U.S. Cl.
CPC ..... *F04C 18/0207* (2013.01); *F04C 29/0092* (2013.01); *F04C 23/008* (2013.01); *F04C 2220/12* (2013.01); *F04C 2220/30* (2013.01)

(58) Field of Classification Search
CPC ..... F04C 18/00; F04C 18/0207; F04C 29/00
USPC ..... 418/55.6, 270, DIG. 1, 46, 47; 184/6.16; 123/559.1
See application file for complete search history.

(56) References Cited

U.S. PATENT DOCUMENTS

| | | | | |
|---|---|---|---|---|
| 5,286,179 | A * | 2/1994 | Forni et al. | 418/55.1 |
| 5,358,387 | A | 10/1994 | Suzuki et al. | |
| 5,785,151 | A * | 7/1998 | Fry et al. | 184/6.16 |

(Continued)

FOREIGN PATENT DOCUMENTS

| | | | |
|---|---|---|---|
| CN | 201412332 | Y | 2/2010 |
| DE | 102007032157 | A1 | 1/2009 |

(Continued)

OTHER PUBLICATIONS

English machine translation of JP2003-301786 by Japan Platform for Patent Information (Nov. 2015).*

*Primary Examiner* — Thai Ba Trieu
*Assistant Examiner* — Deming Wan
(74) *Attorney, Agent, or Firm* — Shumaker & Sieffert, P.A.

(57) ABSTRACT

A scroll compressor (10) comprising a scroll pumping mechanism having two co-operating scrolls (14,16) mounted within a pump housing (18) so that on relative orbital movement of the scrolls fluid is pumped from a pump inlet (20) in the pump housing to a pump outlet (22) in the pump housing. The scroll compressor (10) further comprises a filter (24) located within the pump housing (18) along a fluid flow path (26) between the pump inlet (20) and the scroll pumping mechanism (12) for resisting the passage of particulates (28) upstream of the compressor.

17 Claims, 5 Drawing Sheets

(56) References Cited

U.S. PATENT DOCUMENTS

| | | | | |
|---|---|---|---|---|
| 6,059,540 | A | 5/2000 | Ni | |
| 6,315,536 | B1 * | 11/2001 | DeVore et al. | 418/55.6 |
| 7,104,772 | B2 * | 9/2006 | Tsuboi | 418/201.1 |
| 2002/0034451 | A1 | 3/2002 | Abe et al. | |
| 2005/0028795 | A1 * | 2/2005 | Benson | F02B 33/40 123/559.1 |
| 2007/0166178 | A1 * | 7/2007 | Moreland | 417/423.3 |
| 2007/0183916 | A1 * | 8/2007 | Kim et al. | 418/55.6 |
| 2008/0170955 | A1 * | 7/2008 | Eber et al. | 418/55.3 |
| 2008/0250801 | A1 * | 10/2008 | Lifson et al. | 62/216 |

FOREIGN PATENT DOCUMENTS

| | | | | |
|---|---|---|---|---|
| EP | 1643130 | A1 | 5/2006 | |
| JP | 02245486 | A | 10/1990 | |
| JP | 05113186 | A | 5/1993 | |
| JP | 06323268 | A | 11/1994 | |
| JP | 10159781 | A | 12/1996 | |
| JP | 2003301786 | A | 4/2002 | |
| JP | 2003-301786 | * | 10/2003 | F04C 29/12 |
| KR | 20090040150 | A | 4/2009 | |
| WO | 9405957 | A1 | 3/1994 | |

* cited by examiner

SCROLL COMPRESSOR

The present invention relates to a scroll compressor. In particular, but not exclusively, the invention can relate to a scroll compressor used as a vacuum pump for pumping gases.

A prior art scroll compressor, or pump, comprises a pump housing and a drive shaft having an eccentric shaft portion. The shaft is supported at its concentric portion by bearings, which are fixed relative to the housing, and driven by a motor. Second bearings support an orbiting scroll on the eccentric shaft portion so that during use rotation of the shaft imparts an orbiting motion to the orbiting scroll relative to a fixed scroll for pumping fluid along a fluid flow path between a pump inlet and pump outlet of the compressor.

Each scroll comprises a scroll wall which extends perpendicularly to a generally circular base plate. The orbiting scroll wall co-operates, or meshes, with the fixed scroll wall during orbiting movement of the orbiting scroll. Relative orbital movement of the scrolls causes a volume of gas to be trapped between the scrolls and pumped from the inlet to the outlet.

A scroll pump in this instance is a dry pump and not liquid lubricated and therefore the clearances between the scroll walls must be accurately set during manufacture or adjustment to minimize seepage of fluid through the clearances. The space between the axial ends of a scroll wall of one scroll and the base plate of the other scroll is sealed by tip seals. When bedding in or during use, the tip seals are worn by contact with the opposing scroll base plate, generating tip seal dust. When the pump is used for pumping a clean environment such as a vacuum chamber of a silicon wafer processing apparatus, it is desirable that the tip seal dust does not migrate upstream into the vacuum chamber, particularly during pump down times. It is also desirable that other particulates are swept downstream and prevented from migrating upstream of the pump.

Accordingly, in a vacuum system including a scroll vacuum pump and a vacuum chamber, a filter is typically provided between the vacuum pump and the vacuum chamber. Such a filter collects particulates, such as tip seal dust, and prevents them from migrating upstream causing contamination. Such filters also adsorb gas contaminants such as oil aerosols, oil vapors, certain other hydrocarbon vapors, and trace moisture.

FIG. 5 shows schematically a vacuum system 200 comprising a vacuum chamber 220 which is connected by vacuum lines 230, 250 to a vacuum pump 240. A removable filter 260 is placed between the vacuum pump and the evacuated area 220, typically adjacent to the vacuum chamber, in an area where it is relatively easy for maintenance to be performed. In use of the pump, transconductance from the vacuum chamber deteriorates as the filter becomes clogged and accordingly maintenance of the filters is critical for the correct operation of the vacuum system. Filter maintenance adds to the cost of running a vacuum pump; resulting in downtime and complexity. Internal filter tip debris migration will also occur during downtime, with such debris being ever-present within a vacuum line from a vacuum system. Further, the presence of a filter in the vacuum lines adds to the footprint of the arrangement, additionally increasing cost of ownership. In order to reduce the footprint, prior art arrangements have comprised relatively small filters, however a smaller filter requires maintenance over shorter time periods and again adds to the cost of ownership.

The present invention seeks to provide an improved scroll compressor.

The present invention provides a scroll compressor comprising a scroll pumping mechanism comprising two co-operating scrolls mounted within a pump housing so that on relative orbital movement of the scrolls fluid is pumped from a pump inlet in the pump housing to a pump outlet in the pump housing, wherein the scroll compressor further comprises a filter located within the pump housing along a fluid flow path between the pump inlet and the scroll pumping mechanism for resisting the passage of particulates upstream of the compressor.

Other preferred and/or optional aspects of the invention are defined in the accompanying claims.

In order that the present invention may be well understood, an embodiment thereof, which is given by way of example only, will now be described with reference to the accompanying drawings, in which.

Figure 4A:
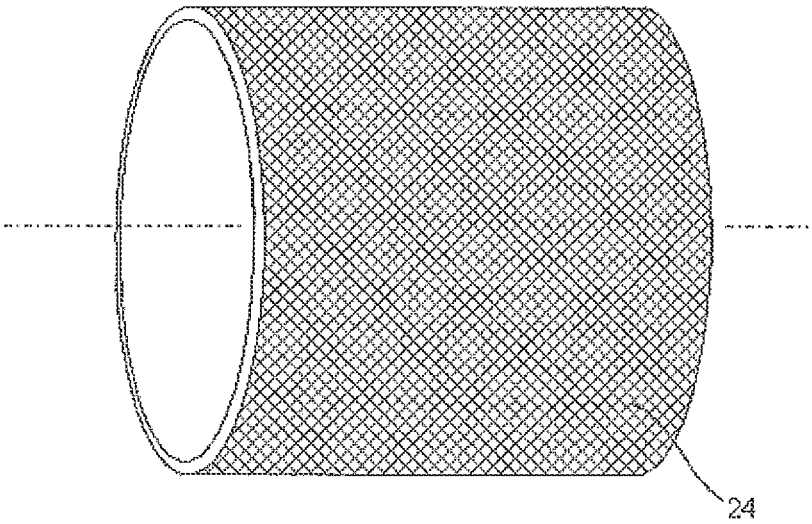
Figure 4B:
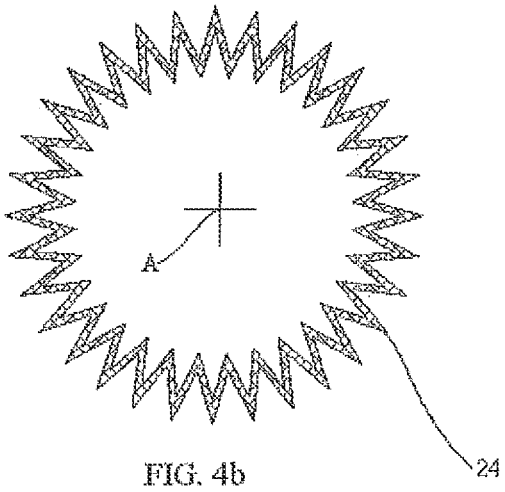
Figure 4C:
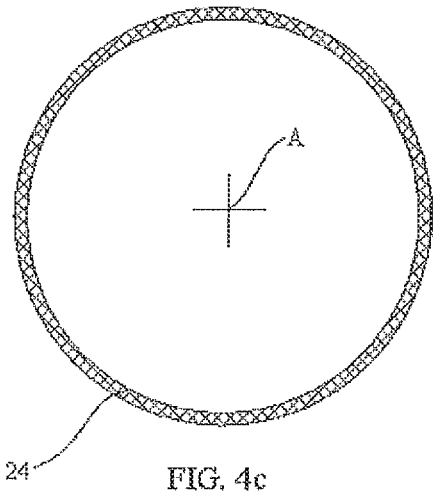
Figure 5:
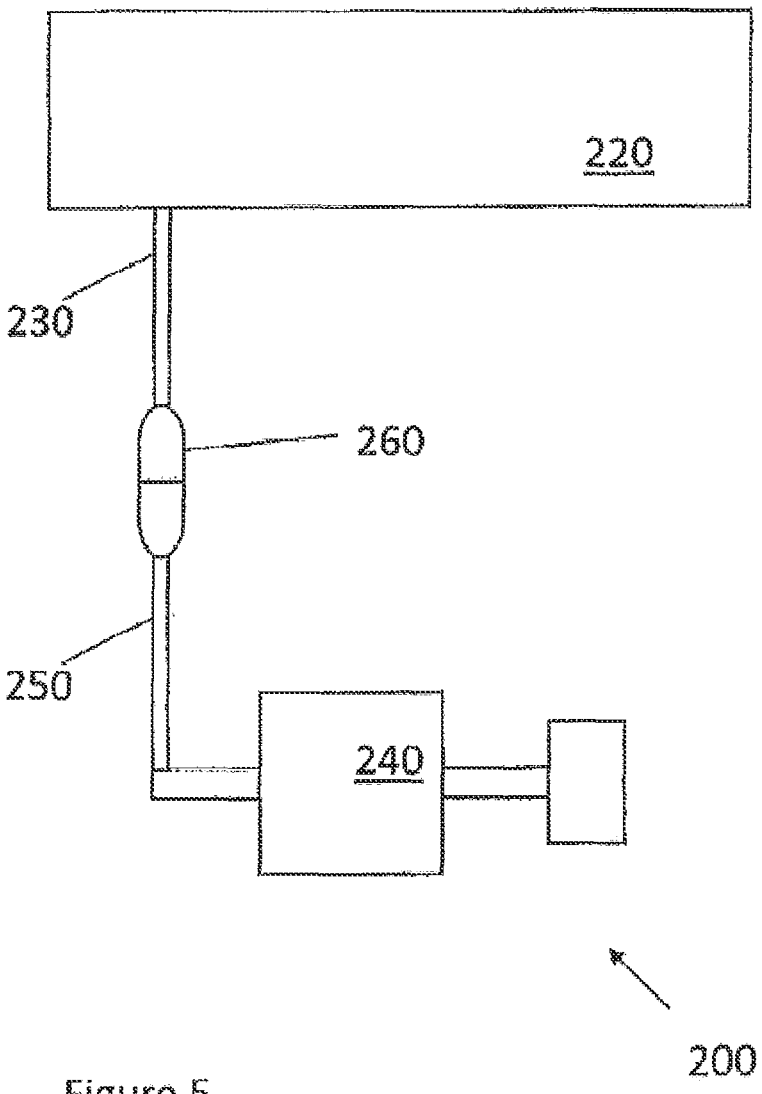

FIGS. 4*a*, 4*b*, 4*c* show three different filters of the first, second and third scroll compressors; and FIG. 5 shows schematically a prior art vacuum system.

Figure 1:
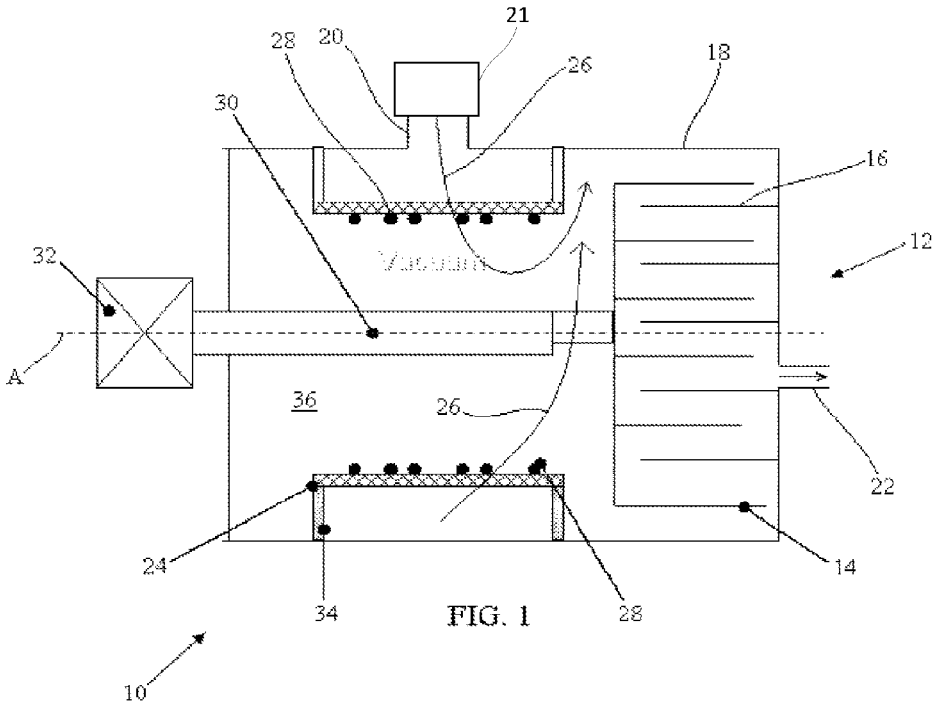
FIG. 1 shows a first scroll compressor.

Referring to FIG. 1, a scroll compressor 10 is shown comprising a scroll pumping mechanism comprising two co-operating scrolls 14, 16 mounted within a pump housing 18 so that on relative orbital movement of the scrolls fluid is pumped from a pump inlet 20 in the pump housing to a pump outlet 22 in the pump housing. The scroll compressor 10 further comprises a filter 24 located within the pump housing 18 along a fluid flow path 26 between the pump inlet 20 and the scroll pumping mechanism 12 for resisting the passage of particulates 28 upstream of the compressor. A low pressure, or vacuum, region 36 is located between the pump inlet and the scroll pumping mechanism and the filter is located in the low pressure region.

The scrolls comprise a fixed scroll 16 and an orbiting scroll 14. An axially extending shaft 30 having an eccentric shaft portion is connected for causing the orbiting scroll to orbit relative to the fixed scroll. The shaft is driven by a motor 32 to rotate about axis A.

As described above in relation to the prior art, dry wearing tip seals are typically used in dry scroll pumps to provide adequate sealing on the axial faces of the scrolls to give good compression. The downside of using tip seals is the back-migration of worn tip seal dust into a vacuum system should back-flow occur.

The filtration requirements for tip seal dust are extremely fine, with the particles ranging typically from 0.1-10 microns. Most filters for this purpose are specified at approximately 1-10 microns. This fine level of filtration has the disadvantage of reduced conductance over time as the filters become clogged meaning that the performance of the pump is often affected. Embodiments of the invention aim to eliminate reduced performance by maximising the surface area of the filter without substantially impacting the size of the pump housing (18), or envelope.

In this regard, the filter 24 is located within an existing previously unoccupied region of the pump so that it is not necessary to increase the footprint of the pump in order to accommodate the filter. In the previously discussed prior art, the filter is required to be small so that it does not significantly increase the footprint of the vacuum system. However, a small filter requires frequent maintenance. Accordingly, in FIG. 1, the surface area of filter 24 available for filtering is relatively large since the unused space available inside the pumping housing and in the region of the pump around the axis A is relatively large and can accommodate a relatively large filter. In this way, even though the space in which the filter 24 is accommodated is relatively inaccessible the filter 24 does not require frequent maintenance. Typically, the filter can be maintained at intervals at which the pump as a whole would require maintenance and therefore in any case it would be necessary to dismantle the pump. In FIG. 1 therefore the filter extends substantially about the axis of the shaft and substantially envelopes the axis A. Preferably in order to provide a large filtering area, the filter is generally cylindrical and extends through 360° about the axis.

The filter 24 therefore provides a large surface area without substantially impacting the space envelope of the pump itself. The large surface area has the advantage of minimising performance loss through the attachment of debris and particulates 28 and minimising the time based requirement for filter replacement. By doing so, the filter can be an internal component that does not need ready access on a frequent basis.

In FIG. 1, the filter 24 is mounted to a wall of the pump housing 18 by one or more supports 34. The interfaces between the supports and the filter are sealed. The scroll compressor 10 also includes a valve 21 disposed upstream of the filter 24 to prevent the passage of particulates upstream of the scroll compressor 10 when the valve 21 is closed.

Figure 2:
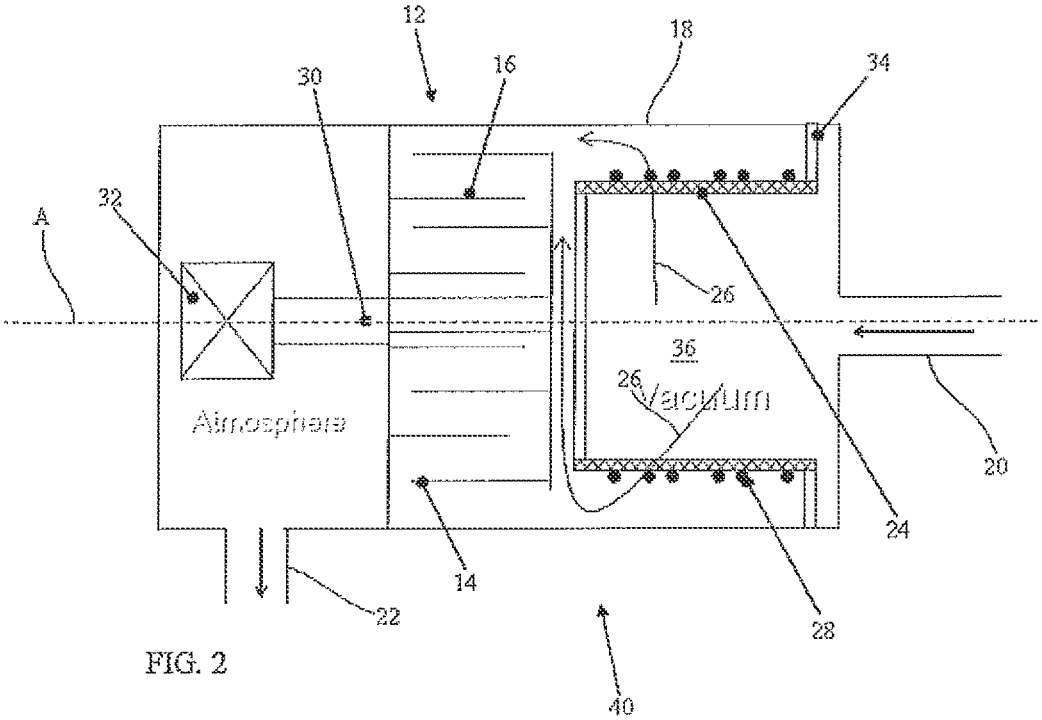
FIG. 2 shows a second scroll compressor.

Referring now to FIG. 2, there is shown a reverse scroll pump 40 in which the shaft 30 extends through the fixed scroll 16 and is connected to the orbiting scroll for imparting an orbiting motion to the orbiting scroll relative to the fixed scroll. The orbiting scroll is therefore on an opposing axial side of the fixed scroll from the motor 32. Whilst the arrangements shown in FIGS. 1 and 2 are different many of the advantages associated with the scroll pump 10 apply equally to scroll pump 40.

In pump 40, the pump housing has been extended in the axial direction to accommodate filter 24. The radial extent of the pump has not been extended. The pump includes an inlet 20 allowing fluid to flow into a vacuum region of the pump between the inlet and the pumping mechanism 12. The filter 24 extends substantially about the axis of the shaft and substantially envelopes the axis A. Preferably in order to provide a large filtering area, the filter is generally cylindrical and extends through 360° about the axis. The filter is mounted to the housing 18 by a radially extending annular member 34. The filter in this example is generally cylindrical and end of the filter which is proximate the pumping mechanism is closed by an annular circular plate 38. Alternatively, this end of the filter may comprise a further filtering surface. As can be seen, the filter, with an outside diameter of 30 cm can provide a large surface are whereby filter replacement need not take place frequently.

The cylindrical filter design has been applied to both forward and reverse scroll forms, as shown in the first and second embodiments. The effective filtering area of the filter can be increased by the use of a pleated filter. Notwithstanding the above, it is to be appreciated that the filter may not extend fully through 360°, since there may not be sufficient space within the pump housing to accommodate a fully cylindrical filter or the fluid flow path may be obstructed and not pass through all of the vacuum region of the pump. Accordingly, the filter may, for example envelope a 270° arc.

FIGS. 4*a, b* & *c* show, respectively, a cylindrical filter element in perspective view, a cross section of the same and a cross-section of the pleated variant. As is shown, the filter utilizes internal space commensurate with the design of the pump mechanism to minimise the impact on overall pump size and performance and to maximise the filtering effectiveness and service intervals. The pleated filter shown in FIG. 4*c* is one example of filter construction for extending, or increasing, the area of the filter available for filtering. Other examples of irregular filtering surfaces will be apparent to those skilled in the art. The filter could be constructed from fabric with wire mesh to provide stiffness or sintered or made from any other combination of materials that deliver the required filtering action, are structurally sound and prevent leakage.

Figure 3:
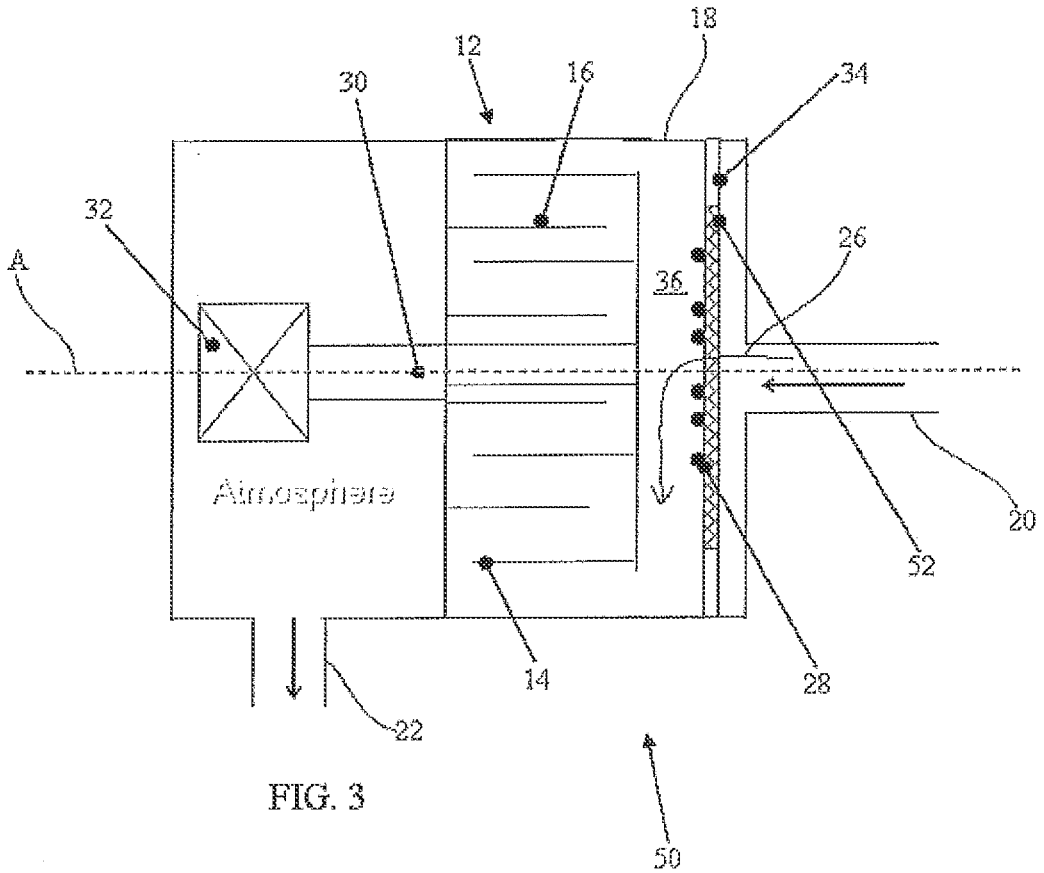
FIG. 3 shows a third scroll compressor.

Referring now to FIG. 3, there is shown a scroll pump 50 comprising a reverse scroll pumping mechanism. The pump comprises a filter in the form of a disc 52 arranged perpendicularly to an axis A of the pump. The construction of pump 50 is similar to that shown in FIG. 2 except that the vacuum region 36 of the pump has not been extended and instead as the filter is disc-shaped, it can be accommodated in a relatively small space along the fluid flow path between the inlet 20 and the vacuum pumping mechanism 12. The filter is located generally perpendicularly to the axis A of the pump in order to reduce the space required inside the pump required for accommodation. As can be seen, the filter 52, with an outside diameter of for example 30 cm can provide a large surface area whereby filter replacement need not take place frequently. The disc filter could, of course, comprise a pleated or other irregular filter element to maximise surface area and effective filtering.

The third embodiment is specific to reverse scroll forms and replaces the tube like construction of the first embodiment with a disc like construction again to minimise the impact on pump size. To maximise surface area of the filter again, the disc would be of a relatively large diameter relative to the orbiting scroll and may have a non flat surface to increase capacity further. In this reverse scroll form case, the filter is more accessible than in the forward scroll form case and as such a slight reduction in area may be tolerated (relating to service intervals). Conveniently, the disc filter can be provided in a moulded arrangement, which can slide in and out of a correspondingly shaped aperture within the housing whereby to provide a simply installed and removed filter.

As indicated above with reference to the embodiments, the filters 24, 52 are located in a vacuum region within the pump housing and along a fluid flow path between the inlet and the pumping mechanism. Typically when designing a scroll pump, the pumping mechanism is first designed in order to achieve the required pumping characteristics. The pump housing is generally designed to have as small a footprint as possible whilst still providing sufficient space for the pumping mechanism. Accordingly, the limiting factor on reducing footprint is usually the size of the pumping mechanism, particularly the radial extent of the pumping mechanism. Therefore, it is advantageous, so as not to increase the footprint of the pump that the filter is located radially inwardly from the outer radial extent of the pumping mechanism. That is the filter sits within the profile of the pumping mechanism as shown in FIGS. 1 to 3.

The filter topology described herein has improved filtering capability, maximises conductance and minimises maintenance requirements such that it can become an integral and internal part of the pump and does not impact the overall pump size. The potential for tip seal dust to contaminate a vacuum system is a key concern associated with scroll pump technology. The provision of a filter solution which substantially eliminates the risk of tip seal dust entering a vacuum system and yet does not need a separate upstream filter unit, as in the prior art, can provide significant advantages.

In the Figures, the filter is in the pump and therefore generally further from the vacuum or processing system. Therefore, the degree of back migration of particles and substances dislodged upon removal of a filter is reduced. This is a particular advantage with scroll pumps which are susceptible to shed dust from tip seals. Conveniently a vacuum valve may be provided whereby complete system flush is not required after replacement of a filter. This has the further advantage that downtime is minimized by not requiring an evacuation of the workplace after a filter change or inspection.

A further significant feature of the embodiments is that the size of the filter can be increased substantially over standard in-line filters, thereby increasing the period between scheduled maintenance. However, one aim of this invention is to prevent back migration of tip seal dust. The applicants have found that by using a filter located internally within the pump housing the problems typically associated with prior filtering methods, namely: an increase in pump dimensions; regular maintenance requirements (due to the use of limited capacity external filters such as in-line cartridge filters); and reduced pumping performance (due to low conductance), can all be overcome.

The inclusion of a filter within the pump after, and proximate to, the inlet of a scroll pump also protects the pump internals downstream of the filter from contamination that could otherwise damage the tip seals, the scrolls and valves and any other sensitive parts of the pump.

Whilst a scroll compressor is typically operated for pumping fluid, instead it can operated as a generator for generating electrical energy when pressurised fluid is used to rotate the orbiting scroll relative to the fixed scroll. The present invention is intended to cover use of the scroll compressor for pumping and energy generation.

The invention claimed is:

1. A scroll compressor comprising:

a scroll pumping mechanism comprising a fixed scroll and an orbiting scroll mounted within a pump housing;

an axially extending shaft having an eccentric shaft portion, wherein the axially extending shaft is connected to the orbiting scroll for causing the orbiting scroll to orbit relative to the fixed scroll to pump fluid from a pump inlet in the pump housing to a pump outlet in the pump housing; and a particulate filter located within the pump housing along a fluid flow path between the pump inlet and the scroll pumping mechanism for resisting the passage of particulates upstream of the compressor, wherein the particulate filter defines a generally cylindrical shape and extends through 360° about the axis of the axially extending shaft, wherein the particulate filter is located radially inwardly from an outer radial extent of the fixed scroll and the orbiting scroll.

2. The scroll compressor of claim 1, further comprising a valve disposed upstream of the filter to prevent the passage of particulates upstream of the scroll compressor when the valve is closed.

3. The scroll compressor of claim 2, wherein the filter has a non-flat surface to increase the surface area available for filtering particulates.

4. The scroll compressor of claim 1, wherein the filter has a non-flat surface construction to increase the surface area available for filtering particulates.

5. The scroll compressor of claim 4, wherein the filter is pleated.

6. The scroll compressor of claim 1, wherein a low pressure region is located between the pump inlet and the scroll pumping mechanism and the filter is located in the low pressure region.

7. The scroll compressor of claim 6, further comprising a valve disposed upstream of the filter to prevent the passage of particulates upstream of the scroll compressor when the valve is closed.

8. The scroll compressor of claim 6, wherein the filter has a non-flat surface to increase the surface area available for filtering particulates.

9. The scroll compressor of claim 1, further comprising a valve disposed upstream of the filter to prevent the passage of particulates upstream of the scroll compressor when the valve is closed.

10. The scroll compressor of claim 1, wherein the filter has a non-flat surface to increase the surface area available for filtering particulates.

11. The scroll compressor of claim 1, wherein the filter has a non-flat surface to increase the surface area available for filtering particulates.

12. The scroll compressor of claim 1, further comprising one or more supports, wherein the particulate filter is mounted to a wall of the pump housing by the one or more supports, and wherein the interfaces between the one or more supports and the particulate filter are sealed.

13. A scroll compressor comprising:

a scroll pumping mechanism comprising a fixed scroll and an orbiting scroll mounted within a pump housing;

an axially extending shaft having an eccentric shaft portion, wherein the axially extending shaft is connected to the orbiting scroll for causing the orbiting scroll to orbit relative to the fixed scroll to pump fluid from a pump inlet in the pump housing to a pump outlet in the pump housing; and a filter located fully within the pump housing along a fluid flow path between the pump inlet and the scroll pumping mechanism for resisting the passage of particulates upstream of the scroll compressor, wherein the filter defines a generally disc shape comprising a cylindrical outer surface joining opposing major surfaces, and wherein the filter is positioned such that one opposing major surface of the opposing major surfaces of the filter are facing the orbiting scroll and the opposing major surfaces are generally perpendicular to the axis of the axially extending shaft.

14. The scroll compressor of claim 13, wherein the opposing major surface of the filter are non-flat surfaces to increase the surface area available for filtering particulates.

15. The scroll compressor of claim 14, wherein the filter is pleated.

16. The scroll compressor of claim 13, further comprising a valve disposed upstream of the filter to prevent the passage of particulates upstream of the scroll compressor when the valve is closed.

17. The scroll compressor of claim 13, further comprising one or more supports, wherein the filter is mounted to a wall of the pump housing by the one or more supports, and wherein the interfaces between the one or more supports and the filter are sealed.

* * * * *